US009241389B2

(12) United States Patent
Piper

(10) Patent No.: US 9,241,389 B2
(45) Date of Patent: Jan. 19, 2016

(54) DIGITAL LIGHTING SUB-NETWORK INTERFACE

(71) Applicant: Martin John Piper, Kent (GB)

(72) Inventor: Martin John Piper, Kent (GB)

(73) Assignee: Cooper Technologies Company, Houston, TX (US)

( * ) Notice: Subject to any disclaimer, the term of this patent is extended or adjusted under 35 U.S.C. 154(b) by 352 days.

(21) Appl. No.: 13/796,123

(22) Filed: Mar. 12, 2013

(65) Prior Publication Data

US 2013/0249442 A1 Sep. 26, 2013

Related U.S. Application Data

(60) Provisional application No. 61/614,793, filed on Mar. 23, 2012.

(51) Int. Cl.
*H05B 37/00* (2006.01)
*H05B 37/02* (2006.01)

(52) U.S. Cl.
CPC ..... *H05B 37/02* (2013.01); *H05B 37/0254* (2013.01)

(58) Field of Classification Search
CPC ..... H05B 33/0842; H05B 37/02; H05B 37/0254; H05B 37/0272; H05B 41/36
USPC ..... 315/312–321
See application file for complete search history.

(56) References Cited

U.S. PATENT DOCUMENTS

| | | | | |
|---|---|---|---|---|
| 7,417,556 | B2 * | 8/2008 | Ling | 340/12.52 |
| 2003/0036807 | A1 * | 2/2003 | Fosler | 700/3 |
| 2007/0018783 | A1 * | 1/2007 | Erhardt | 340/3.5 |
| 2007/0233323 | A1 | 10/2007 | Wiemeyer | |
| 2009/0309512 | A1 | 12/2009 | Schleicher | |
| 2012/0212140 | A1 * | 8/2012 | Kim et al. | 315/151 |
| 2013/0119894 | A1 * | 5/2013 | Yeh et al. | 315/294 |

FOREIGN PATENT DOCUMENTS

WO WO 03/017733 A1 2/2003

OTHER PUBLICATIONS

International Search Report mailed Jul. 11, 2013 for PCT/US2013/033320.

* cited by examiner

*Primary Examiner* — William Hernandez
(74) *Attorney, Agent, or Firm* — King & Spalding LLP

(57) ABSTRACT

A digital sub-network interface unit includes a primary digital lighting interface port to couple to a primary lighting network. An address of the digital sub-network interface unit on the primary lighting network is manually set at the digital sub-network interface unit. The digital sub-network interface unit also includes a secondary digital lighting interface port to couple to a secondary lighting network. The digital sub-network interface unit further includes a lighting sub-network processor. The lighting sub-network processor is configured to assign addresses to a plurality of secondary lighting fixtures, and to receive commands from a primary digital lighting controller in association with an address of the digital sub-network interface unit. The lighting sub-network processor is also configured to control a plurality of secondary lighting fixtures based on the commands received from the primary digital lighting controller.

20 Claims, 4 Drawing Sheets

DIGITAL LIGHTING SUB-NETWORK INTERFACE

RELATED APPLICATIONS

The present application claims priority to U.S. Provisional Patent Application No. 61/614,793, filed Mar. 23, 2012, and titled "Digital Lighting Sub-Network Interface," the entire content of which is incorporated herein by reference.

TECHNICAL FIELD

The present disclosure relates generally to control of lighting fixtures and more particularly to systems, methods, and devices for creating and operating a sub-network on a Digital Addressable Lighting Interface (DALI) lighting control network system.

BACKGROUND

A Digital Addressable Lighting Interface (DALI) network system typically includes a number of lighting fixtures that are attached to a network. A control device that is also attached to the network controls the lighting fixtures. The control device is also generally limited to a control over a particular maximum number of lighting fixtures that are attached to the network. If more than the maximum number of lighting fixtures need to be connected to the network, a separate second network with its own control device is typically required. The lighting fixtures in excess of the maximum number of lighting fixtures directly supportable by the first control device would typically be attached to the second network that has the second control device attached to it.

Further, the control device typically assigns addresses to the lighting fixtures after the lighting fixtures are installed on the network. Thus, identifying individual installed lighting fixtures or groups of lighting fixtures based on addresses assigned by the control device may be time consuming, particularly when a large number of lighting fixtures are installed on a network and/or when the control device assigns the addresses independently of relevant user input.

A device that is relatively easy to install and that enables extending the number of lighting fixtures beyond the maximum number of lighting fixtures that are directly supportable by a control device is desirable. Further, a device that facilitates identification of installed individual light fixtures and groups of lighting fixtures is also desirable.

BRIEF DESCRIPTION OF THE DRAWINGS

Reference will now be made to the accompanying drawings, which are not necessarily drawn to scale, and wherein.

Figure 1:
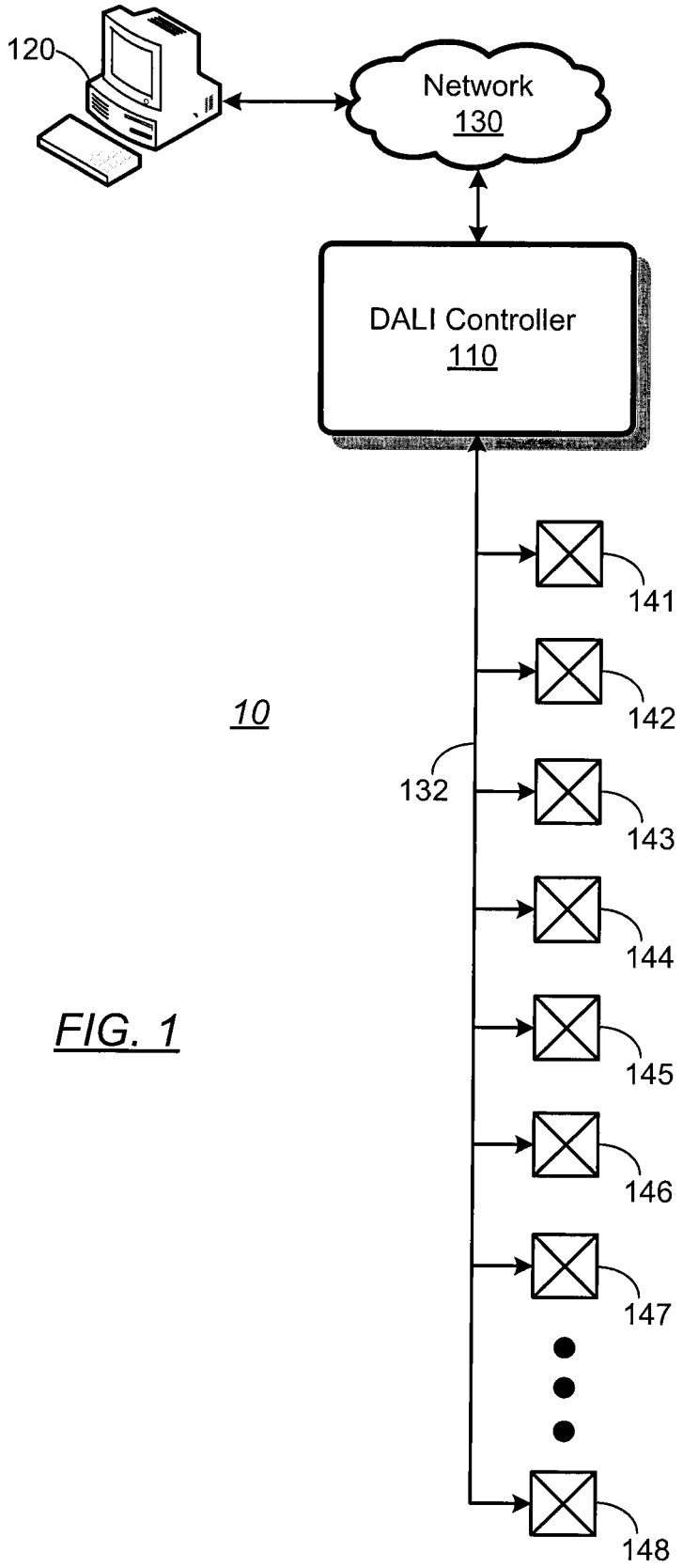
FIG. 1 presents a system illustrating an example operating environment for an example Digital Addressable Lighting Interface (DALI) network lighting control system according to one example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

SUMMARY

The present disclosure relates to systems, methods, and devices for creating and operating a sub-network on a Digital Addressable Lighting Interface (DALI) lighting control network system. In an example embodiment, a digital sub-network interface unit includes a primary digital lighting interface port to couple to a primary lighting network. An address of the digital sub-network interface unit on the primary lighting network is manually set at the digital sub-network interface unit. The digital sub-network interface unit also includes a secondary digital lighting interface port to couple to a secondary lighting network. The digital sub-network interface unit further includes a lighting sub-network processor. The lighting sub-network processor is configured to assign addresses to a plurality of secondary lighting fixtures, and to receive commands from a primary digital lighting controller in association with an address of the digital sub-network interface unit. The lighting sub-network processor is also configured to control a plurality of secondary lighting fixtures based on the received commands from the primary digital lighting controller.

In another example embodiment, a digital sub-network lighting system includes a plurality of primary lighting fixtures communicably coupled to a primary lighting network. The digital sub-network lighting system also includes a primary digital lighting controller communicably coupled to the plurality of primary lighting fixtures and configured to assign addresses to the plurality of primary lighting fixtures. The digital sub-network lighting system further includes a sub-network lighting controller communicably coupled to the primary lighting network and to a secondary lighting network. An address of the sub-network lighting controller on the primary lighting network is manually set at the sub-network lighting controller. The sub-network lighting controller is configured to assign addresses to a plurality of secondary lighting fixtures on the secondary lighting network and to receive commands from the primary digital lighting controller in association with the address of the sub-network lighting controller. The sub-network lighting controller is also configured to control the plurality of secondary lighting fixtures based on the commands received from the primary digital lighting controller.

In another example embodiment, a method for controlling a sub-network and monitoring of lighting fixtures includes manually setting an address of a sub-network lighting controller using a switch bank of the sub-network lighting controller and installing the sub-network lighting controller on a primary lighting network. The method also includes assigning, by the sub-network lighting controller, addresses to a plurality of secondary lighting fixtures on a secondary lighting network of the sub-network lighting controller. The sub-network lighting controller receives commands from a primary digital lighting controller on the primary lighting network and controls the plurality of secondary lighting fixtures based on the received commands from the primary digital lighting controller. The sub-network lighting controller also receives sub-network information from the secondary lighting fixtures.

These and other aspects, objects, features, and embodiments will be apparent from the following description and the appended claims.

DETAILED DESCRIPTION OF THE EXAMPLE EMBODIMENTS

In the following paragraphs, particular embodiments will be described in further detail by way of example with reference to the figures. In the description, well known components, methods, and/or processing techniques are omitted or briefly described. Furthermore, reference to various feature(s) of the embodiments is not to suggest that all embodiments must include the referenced feature(s).

Turning now to the drawings, in which like numerals indicate like elements throughout, example embodiments are described in detail. FIG. 1 presents a system illustrating an example operating environment for an example DALI network lighting control system according to one example embodiment. Referring now to FIG. 1, the system 10 includes a Digital Addressable Lighting Interface (DALI) controller 110 (which is also referred to as a digital lighting controller in this specification), an administrator terminal 120 communicably coupled to the DALI controller 110 via network 130, and multiple lighting fixtures 141-148 communicably coupled to a lighting network 132. The DALI controller 110 may include an SCMD6400 or other similar DALI controller as understood in the art. The DALI controller 110 controls the lighting fixtures 141-148 using control signals and/or messages transmitted via the lighting network 132. It is noted that, in certain example embodiments, each of the lighting fixtures 141-148 can be independently coupled to a power source and that the lighting network 132 provides control signals and not power to the lighting fixtures 141-148.

In certain example embodiments, the DALI controller 110 controls and monitors each of the lighting fixtures 141-148 via the lighting network 132 using unique addresses assigned to each of the lighting fixtures 141-148. In one example embodiment, the unique addresses may be assigned by the DALI controller 110 during initialization or configuration of the system 10. For example, during the initialization or configuration of the system 10, each of the lighting fixtures 141-148 is assigned both an individual address uniquely identifying the lighting element and a group address shared with other lighting elements. As such, each of the lighting fixtures 141-148 may be controlled by the DALI controller 110 with reference to its unique individual or group address.

As one example, each lighting fixture 141-148 may be assigned a unique individual static address in a range from 0 to 63. As such, the lighting network 132 may include up to sixty-four lighting elements that are individually addressable by the DALI controller 110. Fewer than sixty-four lighting elements may also be coupled to the lighting network 132 in various embodiments. In certain example embodiments, the lighting network 132 may include a single pair of wires that forms a communications bus to the lighting fixtures 141-148 on the network 132 and be connected to the lighting elements 141-148 in various topologies. The pair of wires may be connected to a ballast of each of the lighting fixtures 141-148, where each ballast controls the operation (i.e., "on" or "off" or output power) of a respective one of the fixtures 141-148.

The administrator terminal 120 may be used to update settings and control parameters on the DALI controller 110, so that the DALI controller 110 may control and operate the lighting fixtures 141-148 based on predetermined and predefined lighting modes. For example, using flexible software and/or firmware configurations, the DALI controller 110 may organize the lighting fixtures 141-148 into one or more groups of lighting fixtures and control groups of the lighting fixtures 141-148, or control each of the lighting fixtures 141-148 individually. Additionally, one or more switches may be coupled to the lighting network 132, and the DALI controller 110 may control individual lighting fixtures or groups of lighting fixtures based on the settings of the switches. In certain example embodiments, the DALI controller 110 may also receive feedback from each of the lighting fixtures 141-148 based on a query to the lighting fixtures. For example, the feedback may include an "on" or "off" status or failure condition information or data. Thus, the DALI controller 110 is able to receive feedback regarding lighting fixtures which may not be operating properly.

It is noted that setting up the system 10 during initialization or configuration may be time consuming. For example, determining particular locations of each of the plurality of lighting fixtures 141-148 during set up of the system 10 may be especially time consuming if the DALI controller 110 assigns the unique individual addresses of the lighting elements 141-148 randomly. In other words, it may be difficult for a technician to put together groups of the lighting fixtures 141-148, if the addresses of the lighting elements 141-148 are unknown when they are installed. Additionally, the DALI controller 110 may be limited to controlling and/or uniquely addressing a limited number of lighting fixtures over the lighting network 132. As described in the example above, the DALI controller 110 may only be able to uniquely identify and address up to sixty-four lighting fixtures. Thus, it may become necessary to install several DALI controllers when installations requiring greater than sixty-four lighting fixtures are required.

Figure 2:
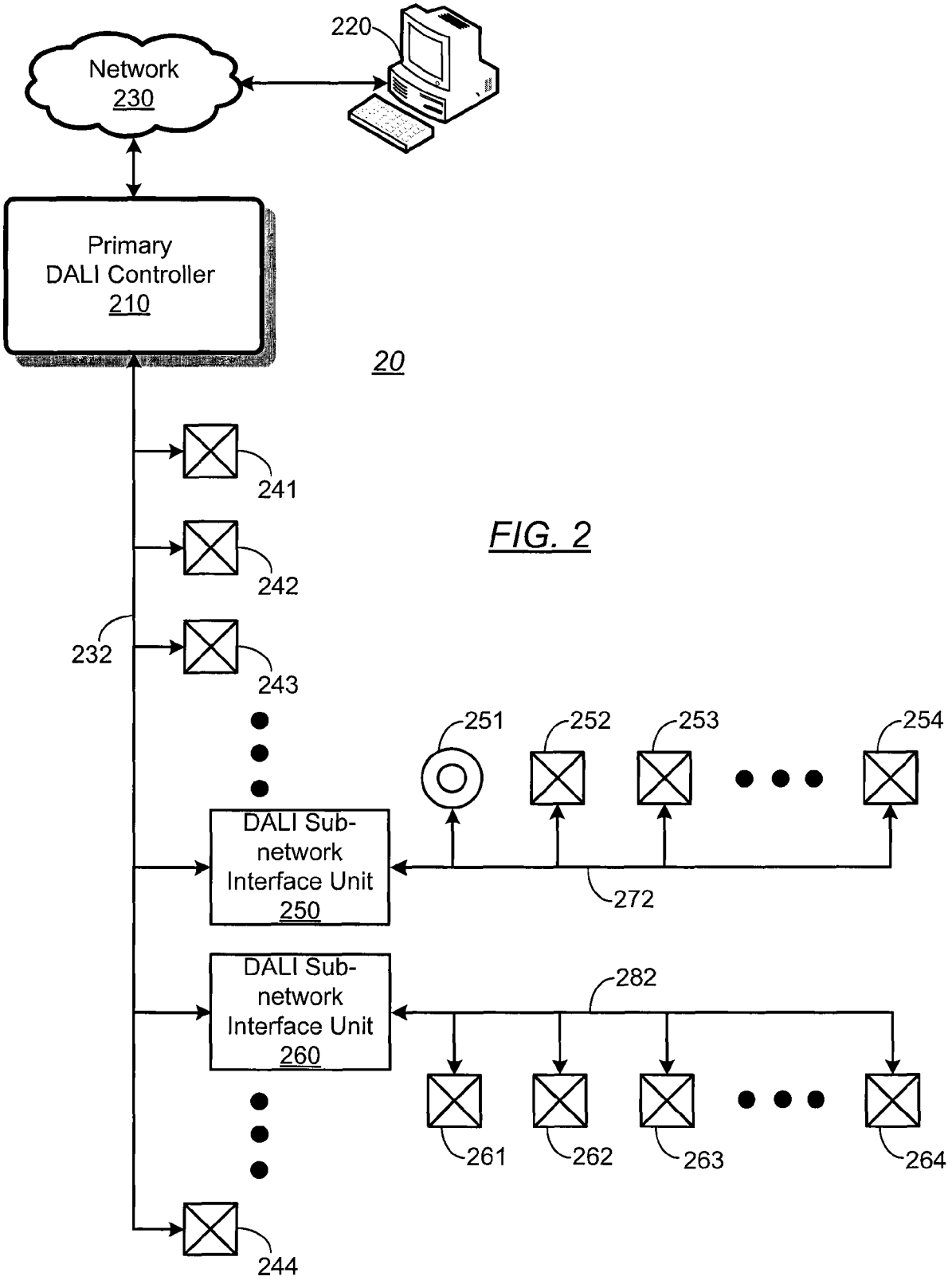
FIG. 2 presents a system illustrating an example operating environment for an example digital sub-network lighting system in an example DALI network lighting control system according to one example embodiment.

FIG. 2 presents a system illustrating an example operating environment for an example digital sub-network lighting system 20 in an example DALI lighting control network system according to one example embodiment. Referring now to FIGS. 1 and 2, the example sub-network system 20 will be compared to the example system 10 of FIG. 1. As compared to system 10, the system 20 includes DALI sub-network interface units 250 and 260, which are also referred to as sub-network lighting controllers in this specification. In certain example embodiments, the system 20 includes an administrative terminal 220, a network 230, a primary DALI controller 210 (which is also referred to as a digital lighting controller in this specification), a plurality of primary lighting fixtures 241-244 communicably coupled to a primary lighting network 232, and the DALI sub-network interface units 250 and 260. The lighting network 232 may include a single pair of wires that forms a communications bus to the primary lighting fixtures 241-244 and to the DALI sub-network interface units 250 and 260. Each of the DALI sub-network interface units 250 and 260 is communicably coupled to secondary lighting networks 272 and 282, respectively. The DALI sub-network interface unit 250 is communicably coupled to the secondary lighting network 272. Secondary lighting fixtures 251-254 are also communicably coupled to the secondary lighting network 272. Similarly, the DALI sub-network interface unit 260 is communicably coupled to secondary lighting network 282, and the secondary lighting fixtures 261-264 are communicably coupled to the secondary lighting network 282. Each of the secondary lighting networks 272 and 282 may support several secondary lighting fixtures, such as 16 lighting fixtures, for example.

The DALI sub-network interface units 250 and 260 assign addresses to the respective plurality of secondary lighting fixtures 251-254 and 261-264 on the respective secondary lighting network 272, 282. The DALI sub-network interface units 250 and 260 may assign unique individual and group addresses to the secondary lighting fixtures 251-254 and 261-264, respectively.

The DALI sub-network interface unit 250 assigns addresses to the plurality of secondary lighting fixtures 251-254 on the secondary lighting network 272. For example, the DALI sub-network interface unit 250 may assign a unique individual address and a group address to each lighting fixture coupled to the secondary network 272. A unique individual address is assigned to an individual lighting fixture of the plurality of secondary lighting fixtures 251-254, and the group address is assigned to two or more lighting fixtures of the plurality of secondary lighting fixtures 251-254. The DALI sub-network interface unit 250 also receives one or more commands from the primary DALI controller 210. The one or more commands from the primary DALI controller 210 are sent to the DALI sub-network interface unit 250 in association with an address of the DALI sub-network interface unit 250 on the primary network 232. The DALI sub-network interface unit 250 also transmits sub-network information to the primary DALI controller 210 in association with an address of the DALI sub-network interface unit 250 on the primary network 232. The address of the DALI sub-network interface unit 250 on the primary lighting network 232 may be manually set at the DALI sub-network interface unit 250. For example, a user (e.g., a technician) may manually set the address of the DALI sub-network interface unit 250 using a switch bank (e.g., one or more Dual In-line Package (DIP) switches) included in or attached to the DALI sub-network interface unit 250 by physically changing a switch position of one or more switches of the switch bank. In certain example embodiments, the DALI sub-network interface unit 250 controls the plurality of secondary lighting fixtures 251-254 based on the one or more commands received from the primary DALI controller 210 via the primary lighting network 232. In certain example embodiments, the DALI sub-network interface unit 250 may itself be re-initialized by a command from the primary DALI controller 210.

In certain example embodiments, the DALI sub-network interface unit 260 assigns addresses to the plurality of secondary lighting fixtures 261-264 on the secondary lighting network 282. For example, the DALI sub-network interface unit 260 assigns a unique individual address and a group address to each lighting fixture coupled to the secondary network 282. The DALI sub-network interface unit 260 also receives one or more commands from the primary DALI controller 210 associated with an address of the DALI sub-network interface unit 260 on the primary network 232. Similar to the DALI sub-network interface unit 250, the DALI sub-network interface unit 260 also transmits sub-network information to the primary DALI controller 210 in association with the address of the DALI sub-network interface unit 260 on the primary network 232. In certain example embodiments, the DALI sub-network interface unit 260 controls the plurality of secondary lighting fixtures 261-264 based on the one or more commands received from the primary DALI controller 210 via the primary lighting network 232. In certain example embodiments, the DALI sub-network interface unit 260 may itself be re-initialized by a command from the primary DALI controller 210.

In certain example embodiments, the DALI sub-network interface units 250 and 260 receive information, such as status information and failure condition information, from the secondary lighting fixtures 251-254 and 261-264 via the secondary lighting networks 272 and 282, respectively, and relay the information to the primary DALI controller 210 via the primary lighting network 232.

In certain example embodiments, the DALI sub-network interface units 250 and 260 detect when a new ballast or a secondary lighting fixture has been attached to its respective secondary network. For example, once the DALI sub-network interface units 250 and 260 are coupled to the primary lighting network 232, each of the DALI sub-network interface units 250 and 260 may detect addition of a ballast or a secondary lighting fixture to the respective secondary lighting networks 272 and 282. Upon detecting that a new ballast or secondary lighting fixtures has been attached to its secondary network 272, the DALI sub-network interface unit 250 can automatically initialize the new ballast or secondary lighting fixture, and provide the new fixture with a new unique individual address and/or group address. Similarly, upon detecting that a new ballast or a secondary lighting fixture has been attached to its secondary network 282, the DALI sub-network interface unit 260 can automatically initialize the new ballast or secondary lighting fixture, and provide the new fixture with a new unique individual address and/or a group address.

In certain example embodiments, the sub-network 272 includes a sensor 251 as one of the lighting fixtures 251-254. In other words, as noted above, lighting fixtures may include elements other than lights or luminaries. For example, lighting fixtures may include sensors, switches, control panels, and other devices. According to certain example embodiments, the sensor 251 can be a motion sensor, photo sensor, passive infrared sensor or other similar sensor device. In connection with the sensor 251, the DALI sub-network interface unit 250 is further able to control one or more of the lighting fixtures on the secondary network 272 based on feedback signals provided by the sensor 251. For example, the DALI sub-network interface unit 250 may turn all of the lighting fixtures 252-254 on, off, or set all of the lighting fixtures 252-254 to any attainable level between on and off based on feedback information gathered using the sensor 251. The logic to provide control of lighting fixtures based on a feedback signal from a sensor would usually be embodied within the Primary DALI Controller 210, another device on Network 230, or within the administrative terminal 220. However, in the sub-network system 20, the DALI sub-network interface unit 250 may not require any instruction or command from the primary DALI controller 210 to control lighting fixtures on the secondary network 272. That is, the DALI sub-network interface unit 250 may create an independent DALI network of devices.

In the example system 20, the primary DALI controller 210 may uniquely address and communicate with each of the primary lighting fixtures 241-244 and the DALI sub-network interface units 250 and 260 via the primary lighting network 232. However, the primary DALI controller 210 may not uniquely address and communicate with any of the secondary lighting fixtures 251-254 and 261-264. That is, in certain example embodiments, the secondary lighting fixtures 251-254 and 261-264 are only separately addressable by one of the DALI sub-network interface units 250 and 260. It is noted that, in this example embodiment, to the primary DALI controller 210, the DALI sub-network interface units 250 and 260 appear to be standard DALI lighting fixtures having unique and group addresses. Thus, to control the secondary lighting fixtures 251-254 and 261-264, the primary DALI controller 210 may address a command to one of the DALI sub-network interface units 250 and 260. In turn, the DALI sub-network interface units 250 and 260 pass commands received from the primary DALI controller 210 to the respective secondary lighting fixtures 251-254 and 261-264. In this manner, the number of lighting fixtures controlled via the primary lighting network 232 by the primary DALI controller 210 is increased beyond sixty-four, although the secondary lighting fixtures 251-254 and 261-264 may not be addressed separately.

According to other aspects of the example system 20, although the secondary lighting fixtures 251-254 and 261-264 may not be addressed separately by the primary DALI controller 210, failure data or other information from a secondary lighting fixtures may still be communicated to the primary DALI controller 210 in association with an address assigned to a secondary DALI sub-network interface unit supporting the lighting fixtures. Thus, the primary DALI controller 210 may identify a failure of one of the secondary lighting fixtures 251-254 associated with the address of the DALI sub-network interface unit 250. Similarly, the primary DALI controller 210 may identify a failure of one of the secondary lighting fixtures 261-264 associated with the address of the DALI sub-network interface unit 260. In other words, the primary DALI controller 210 may associate a failure of one of the secondary lighting fixtures 251-254 and 261-264 with a failure on one of the sub-networks 272 and 282, even if it is unable to determine an actual address of the specific lighting fixture that has had a failure.

By using the DALI sub-network interface units 250 and 260, the number of lighting fixtures in the example sub-network system 20 can be extended in excess of the number of the plurality of primary lighting fixtures directly attached to the lighting network 232 without requiring another primary DALI controller. Further, by setting particular addresses of the DALI sub-network interface units 250 and 260 by a user (e.g., a technician) at or before installation time, the DALI sub-network interface units 250 and 260 can be associated with the particular addresses on the lighting network 232. During operation of the sub-network system 20, because the addresses of the DALI sub-network interface units 250 and 260 are known at installation, information conveyed to a user (e.g., a technician) by the primary DALI controller 210 with respect to an address of either one of the DALI sub-network interface units 250 and 260 can be easily identified as corresponding to the respective DALI sub-network interface unit 250 or 260. Further, because each one of the DALI sub-network interface units 250 and 260 controls a respective group of secondary lighting fixtures 251-254 or 261-264, information provided by the primary DALI controller 210 to the user about either one of the DALI sub-network interface units 250 or 260 can be identified as corresponding to the respective group of secondary lighting fixtures 251-254 or 261-264.

Although FIG. 2 shows a single sensor 251 attached to the sub-network 272, in alternative embodiments, more than one sensor may be attached to the sub-network 272. Further, in alternative embodiments, fewer than three lighting fixtures may be attached to the sub-network 272. Although two DALI sub-network interface units are shown in FIG. 3, in alternative embodiments, fewer than two or more than two DALI sub-network interface units may be attached to the primary network 232.

Figure 3:
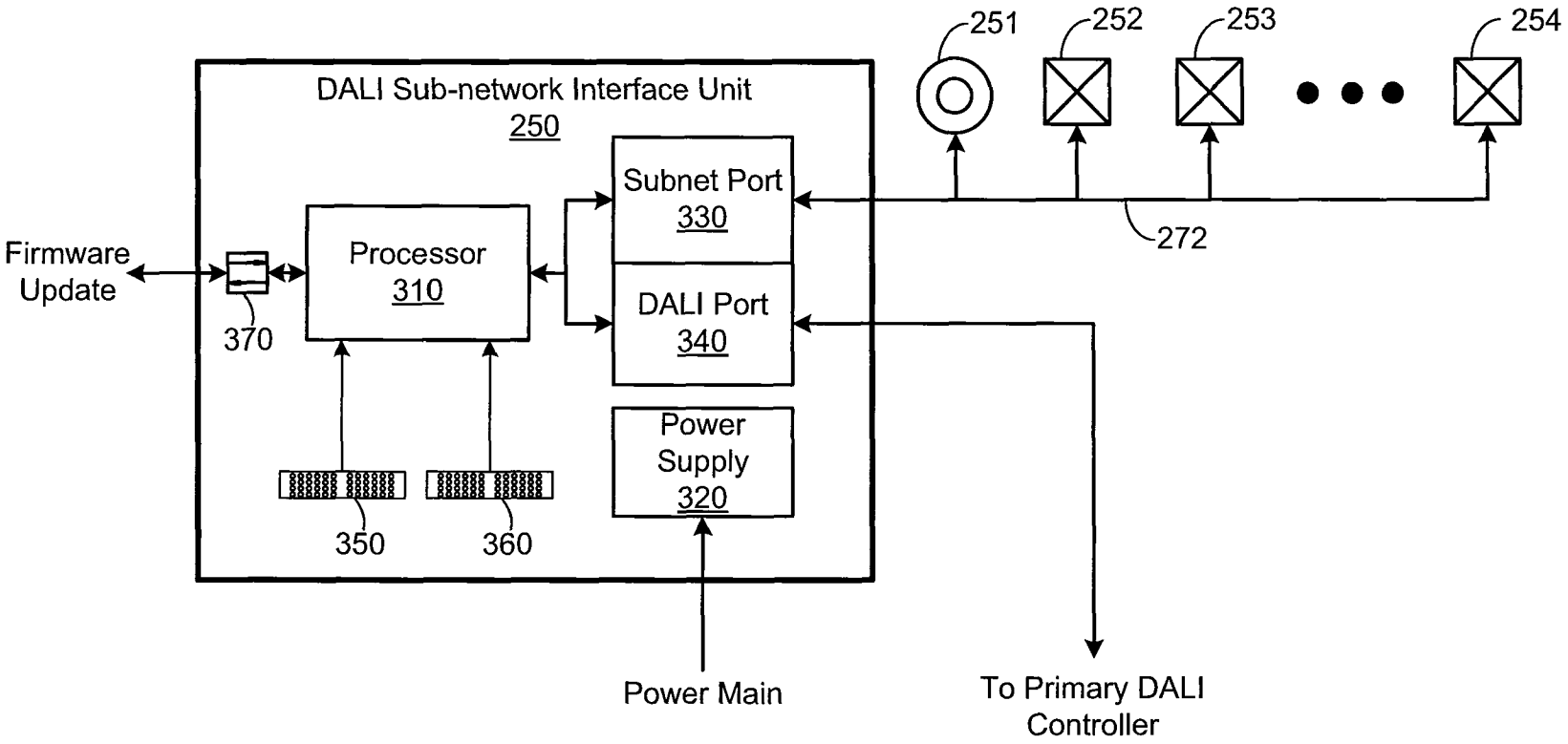
FIG. 3 is a schematic diagram of an example DALI sub-network interface unit according to one an embodiment.

FIG. 3 is a schematic diagram of the example DALI sub-network interface unit 250 according to one example embodiment. Referring now to FIG. 3, the example DALI sub-network interface unit 250 includes a processor 310, a power supply 320, a sub-net port 330, a DALI port 340, a firmware update port 370, and switch banks 350 and 360. In certain example embodiments, the processor 310 controls the overall operation of the DALI sub-network interface unit 250 and communicates with a primary DALI controller, such as the primary DALI controller 210, via the DALI port 340. The processor 310 also communicates with secondary lighting fixtures, such as the secondary lighting fixtures 251-254, on a secondary network, such as the secondary network 272, via the sub-net port 330. For example, the processor 310 may control the secondary lighting fixtures based on a feedback signal received from a sensor (e.g., the sensor 251) attached to the secondary lighting network. To illustrate, the processor 310 may turn the secondary lighting fixtures on, off, or to a level between on and off based on information received from the sensor.

In certain example embodiments, the processor 310 may detect a new lighting fixture attached on the secondary lighting network. In response to detecting that a new lighting fixture is attached on the secondary lighting network, the processor 310 may assign a unique individual address to the new lighting fixture.

In certain example embodiments, the sub-net port 330 is a digital lighting interface port that includes circuitry and other logic necessary for encoding and decoding data messages communicated via a secondary lighting network. The example DALI port 340 is a digital lighting interface port that includes circuitry and other logic necessary for communicating with a primary DALI controller over a primary lighting network.

In certain example embodiments, the power supply 320 includes circuitry and other logic to provide power to each element of the DALI sub-network interface unit 250. Generally, the power supply 320 is provided with a line voltage and converts the line voltage to an appropriate direct current voltage for the lighting fixtures controllable by the DALI sub-network interface unit 250. In one example embodiment, the line voltage provided to the power supply 320 is 230 VAC 50/60 Hz but other voltage versions can be made available. In one example embodiment, the firmware update port 370 includes circuitry and other logic necessary for updating the firmware and/or software executed by the processor 310. The firmware update port 370 may also include a memory device to store the firmware and/or software that is executed by the processor 310. In one example embodiment, the example switch bank 350 includes a plurality of Dual In-line Package (DIP) switches to manually set unique individual and group addresses of the DALI sub-network interface unit 250 on a primary lighting network. In certain example embodiments, the switch bank 360 may include multiple DIP switches for setting up the sub-net port 330.

Using the switch bank 350, a technician may set the unique and group addresses of the DALI sub-network interface 250 on a primary lighting network before installation of the sub-network interface unit 250 on the primary lighting network. For example, a technician may physically set the address of the DALI sub-network interface unit 250 by physically changing a position of one or more switches of the switch bank 350. Thus, after setting the addresses of the DALI sub-network interface unit 250, a primary DALI controller may uniquely identify the DALI sub-network interface unit 250 without any requirement to assign addresses to the DALI sub-network interface unit 250. This aspect of the DALI sub-network interface unit 250 may help to save time during installation and configuration of lighting systems incorporating the DALI sub-network interface unit 250. Further, using the DALI sub-network interface 250, a primary lighting network may be extended to include more than sixty-four lighting fixtures.

With reference again to FIG. 2 for a further description of the operation of the system 20, if the primary DALI controller 210 communicates a "turn on" command to the DALI sub-network interface unit 250, the DALI sub-network interface unit 250 sends associated commands to all of the secondary lighting fixtures 252-254 on its secondary lighting network 272. In one example embodiment, for example, the DALI sub-network interface unit 250 forwards commands received from the primary DALI controller 210 to all of the secondary lighting fixtures 252-254 on its secondary lighting network 272. In this context, the DALI sub-network interface unit 250 appears to the primary DALI controller 210 as a generic lighting fixture or luminaire on the primary lighting network 232, such as any one of the lighting fixtures 241-244. Because the example DALI sub-network interface unit 250 receives information and data including failure codes from the fixtures 251-254 communicably coupled to the secondary lighting network 272, the DALI sub-network interface unit 250 is able to relay such failure or other data to the primary DALI controller 210 in association with its uniquely assigned address set by the switch bank 350, so that the primary DALI controller 210 may identify the failure as being on the secondary lighting network 272.

In turn, the primary DALI controller 210 is able to indicate to a user that a failure has occurred on the secondary lighting network 272 based on the failure data relayed to the primary DALI controller 210 by the DALI sub-network interface unit 250 in association with its uniquely assigned address. In this case, although the primary DALI controller 210 may not be able to uniquely identify to the user which specific lighting fixture 251-254 on the secondary lighting network 272 has failed, the user is at least able to determine that the failure is on the secondary network 272.

Although FIG. 3 illustrates two switch banks 350 and 360, in alternative embodiments, the DALI sub-network interface unit 250 may include fewer or more than two switch banks Further, two or more of the individual components of the DALI sub-network interface unit 250, such as the subnet port 330, the DALI port 340, and the firmware update port 370, although shown in FIG. 3 as separate elements, may be combined into fewer number of elements. Further, in some embodiments, the DALI sub-network interface unit 250 may include a standalone memory device outside of the firmware update port 370 to store code and/or data related to, for example, operations of the processor 310.

Figure 4:
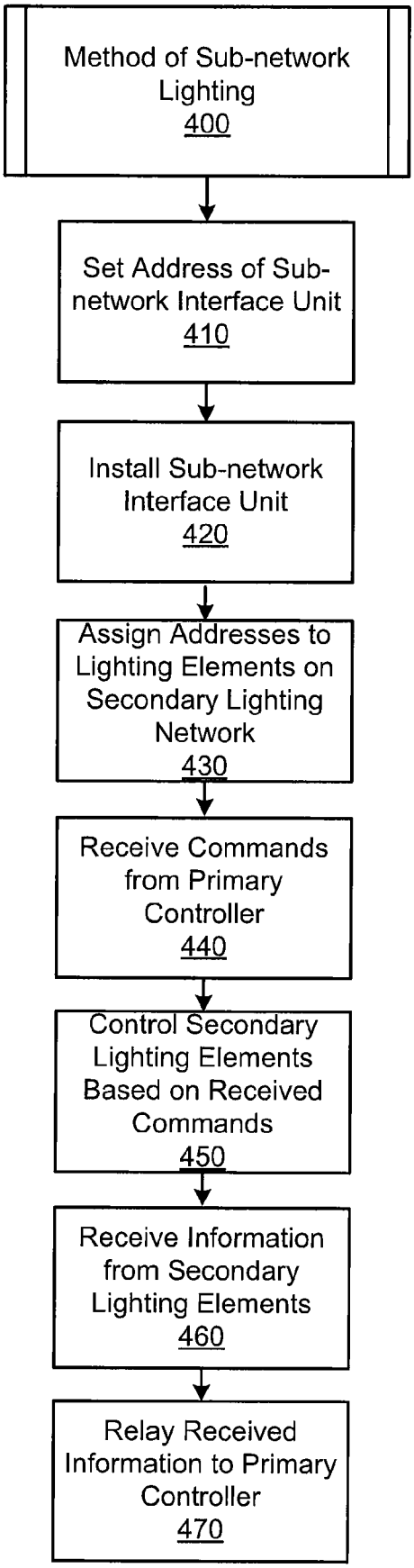
FIG. 4 presents a flowchart of an example method for an operation of an example sub-network lighting system according to one example embodiment.

FIG. 4 presents a flowchart of an example method 400 for the operation of a sub-network lighting system according to one example embodiment. Now referring to FIGS. 2-4, the example method 400 is described in connection with the elements of system 20. At step 410, an address of a sub-network interface unit, such as the DALI sub-network interface unit 250, is set. For example, the address of the sub-network interface unit may be manually set using a switch bank located at the sub-network interface unit. Both unique individual and group addresses may be manually set at step 410 using the bank of DIP switches, for example. At step 420, the DALI sub-network interface unit 250 is installed. Installation of the DALI sub-network interface unit 250 at step 420 may include connecting the DALI sub-network interface unit 250 to power, to a primary lighting network, and to a secondary lighting network, as described above. Installation may also include the installation of secondary lighting elements on the secondary lighting network, as necessary. After installation at step 420, the DALI sub-network interface unit 250 assigns addresses to the secondary lighting fixtures, such as the secondary lighting fixtures 251-254, on the secondary lighting network at step 430. That is, the DALI sub-network interface unit 250 may assign unique and group addresses to the secondary lighting fixtures 251-254.

At step 440, the DALI sub-network interface unit 250 receives one or more commands from a primary DALI controller, such as the primary DALI controller 210, over the primary lighting network. In turn, the DALI sub-network interface unit 250 controls the secondary lighting fixtures 251-254 on the secondary lighting network based on the commands received from the primary DALI controller 210 at step 450. For example, the DALI sub-network interface unit 250 may turn on, off, or set to a level between on and off based on the commands received from the primary DALI controller 210. In addition to receiving commands from the primary DALI controller 210 over the primary lighting network, in certain example embodiments, the DALI sub-network interface unit 250 also receives information from the secondary lighting fixtures 251-254 over the secondary lighting network at step 460.

As described above, the information received from the secondary lighting fixtures 251-254 may include status or failure information or data. After receiving information from the secondary lighting fixtures 251-254 at step 460, the DALI sub-network interface unit 250 relays the information to the primary DALI controller 210 at step 470, in association with the address of the DALI sub-network interface unit 250 set in step 410.

Although particular embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. A digital sub-network interface unit, comprising:

a primary digital lighting interface port to couple to a primary lighting network, wherein an address of the digital sub-network interface unit on the primary lighting network is manually set at the digital sub-network interface unit;

a secondary digital lighting interface port to couple to a secondary lighting network; and a lighting sub-network processor configured to:

assign addresses to a plurality of secondary lighting fixtures, receive commands from a primary digital lighting controller in association with the address of the digital sub-network interface unit, and control the plurality of secondary lighting fixtures based on the commands received from the primary digital lighting controller.

2. The digital sub-network interface unit of claim 1, wherein the lighting sub-network processor is configured to relay sub-network information to the primary digital lighting controller and wherein the lighting sub-network processor is configured to relay the sub-network information in association with the address of the digital sub-network interface unit.

3. The digital sub-network interface unit of claim 2, wherein the sub-network information comprises one or more failure codes from at least one lighting fixture of the plurality of secondary lighting fixtures.

4. The digital sub-network interface unit of claim 2, further comprising a firmware update port to receive firmware updates to a firmware executable by the lighting sub-network processor.

5. The digital sub-network interface unit of claim 1, wherein the addresses include unique individual addresses and a group address, wherein each of the unique individual addresses is assigned to a respective lighting fixture of the plurality of secondary lighting fixtures, and wherein the group address is assigned to two or more lighting fixtures of the plurality of secondary lighting fixtures.

6. The digital sub-network interface unit of claim 1, wherein the lighting sub-network processor is configured to control the plurality of secondary lighting fixtures based on a feedback signal received from a sensor attached to the secondary lighting network.

7. The digital sub-network interface unit of claim 1, wherein the lighting sub-network processor is configured to turn the plurality of secondary lighting fixtures on, off, or to a level between on and off based on information received from a sensor.

8. The digital sub-network interface unit of claim 1, further comprising a switch bank for manually setting the address of the digital sub-network interface unit.

9. The digital sub-network interface unit of claim 1, wherein the lighting sub-network processor is further configured to detect a new lighting fixture attached to the secondary lighting network.

10. The digital sub-network interface unit of claim 9, wherein the lighting sub-network processor is further configured to assign a unique individual address to the new lighting fixture in response to detecting that the new lighting fixture is attached to the secondary lighting network.

11. A digital sub-network lighting system, comprising:

a plurality of primary lighting fixtures communicably coupled to a primary lighting network;

a primary digital lighting controller communicably coupled to the plurality of primary lighting fixtures and configured to assign addresses to the plurality of primary lighting fixtures; and a sub-network lighting controller communicably coupled to the primary lighting network and to a secondary lighting network, wherein an address of the sub-network lighting controller on the primary lighting network is manually set at the sub-network lighting controller, the sub-network lighting controller configured to:

assign addresses to a plurality of secondary lighting fixtures coupled to the secondary lighting network, receive commands from the primary digital lighting controller in association with the address of the sub-network lighting controller, and control the plurality of secondary lighting fixtures based on the commands received from the primary digital lighting controller.

12. The digital sub-network lighting system of claim 11, wherein the sub-network lighting controller is configured to relay sub-network information received from the plurality of secondary lighting fixtures to the primary digital lighting controller and wherein the sub-network lighting controller is configured to relay the sub-network information in association with the address of the sub-network lighting controller on the primary lighting network.

13. The digital sub-network lighting system of claim 12, wherein the sub-network information comprises status information from at least one lighting fixture of the plurality of secondary lighting fixtures.

14. The digital sub-network lighting system of claim 11, wherein the sub-network lighting controller comprises a switch bank for manually setting the address of the sub-network lighting controller, the address of the sub-network lighting controller comprising an individual address of the sub-network lighting controller on the primary lighting network.

15. The digital sub-network lighting system of claim 11, further comprising a sensor attached to the secondary lighting network.

16. A method for monitoring and controlling lighting fixtures of a sub-network, the method comprising:

manually setting an address of a sub-network lighting controller using a switch bank of the sub-network lighting controller;

installing the sub-network lighting controller on a primary lighting network;

assigning, by the sub-network lighting controller, addresses to a plurality of secondary lighting fixtures on a secondary lighting network;

receiving, by the sub-network lighting controller, commands from a primary digital lighting controller coupled to the primary lighting network;

controlling, by the sub-network lighting controller, the plurality of secondary lighting fixtures based on the commands received from the primary digital lighting controller; and receiving, by the sub-network lighting controller, sub-network information from the secondary lighting fixtures.

17. The method of claim 16, further comprising relaying, by the sub-network lighting controller, the sub-network information received from the secondary lighting fixtures to the primary digital lighting controller in association with the address of the sub-network lighting controller.

18. The method of claim 16, further comprising connecting the plurality of secondary lighting fixtures to the sub-network.

19. The method of claim 16, further comprising controlling, by the sub-network lighting controller, the plurality of secondary lighting fixtures based on feedback information received from a sensor attached to the secondary lighting network.

20. The method of claim 16, further comprising detecting a new lighting fixture attached to the secondary lighting network.

* * * * *